United States Patent [19]

Keenan et al.

[11] Patent Number: 4,735,331

[45] Date of Patent: Apr. 5, 1988

[54] COLLAPSIBLE BIN

[75] Inventors: Daniel J. Keenan, Rochester; Duane K. Krause, Grosse Pointe Woods, both of Mich.

[73] Assignee: Chrysler Motors Corporation, Highland Park, Mich.

[21] Appl. No.: 34,193

[22] Filed: Apr. 6, 1987

[51] Int. Cl.[4] ..... B65D 7/24

[52] U.S. Cl. ..... 220/6; 220/7; 220/1.5

[58] Field of Search ..... 220/7, 6, 1.5

[56] References Cited

U.S. PATENT DOCUMENTS

| | | | |
|---|---|---|---|
| 1,063,424 | 6/1913 | Fash | 220/6 |
| 2,486,532 | 11/1949 | Kubach | 220/6 X |
| 2,756,894 | 7/1956 | Phillips | 220/6 |
| 2,804,227 | 8/1957 | Elfgren | 220/19 X |
| 4,240,555 | 12/1980 | Jurasek | 220/19 X |
| 4,674,647 | 6/1987 | Gyenge et al. | 220/6 |

*Primary Examiner*—Steven M. Pollard

*Attorney, Agent, or Firm*—Edward A. Craig

[57] ABSTRACT

The collapsible bin consturction has an erected configuration and a storage configuration. The bin has four side walls which are arranged at different vertical levels so that when they are collapsed, they are vertically spaced apart to permit them to lie in a relatively flat position. Side wall access opening means are provided to permit loading or unloading of the bin via the side walls. Additionally, a top wall is provided which is hingedly mounted to permit loading or unloading of the bin from the top.

2 Claims, 6 Drawing Sheets

FIG.5
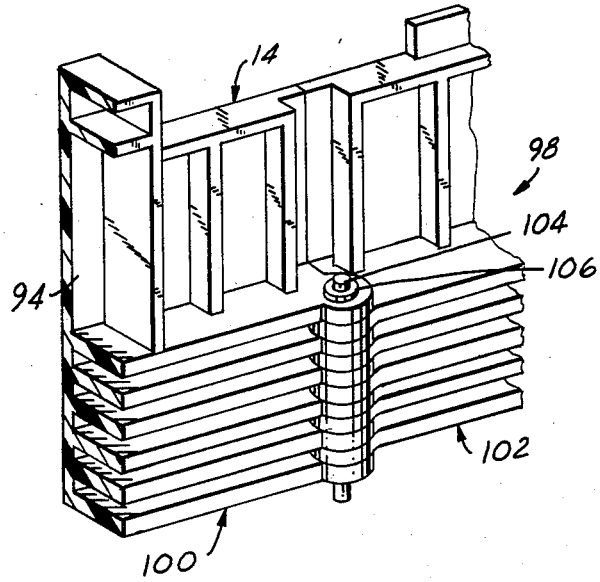
FIG.6
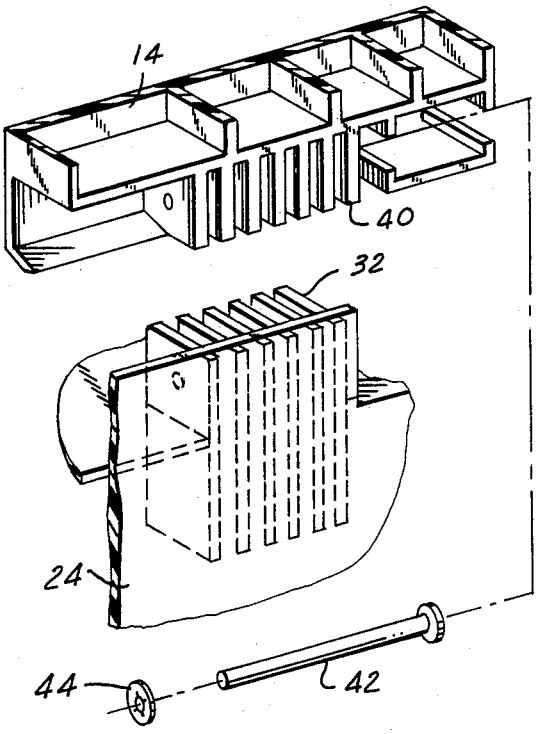
FIG.7
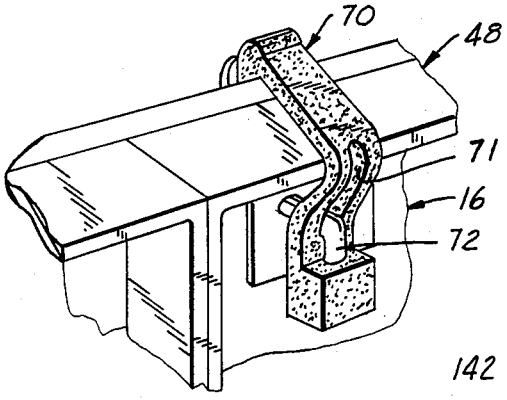
FIG.8
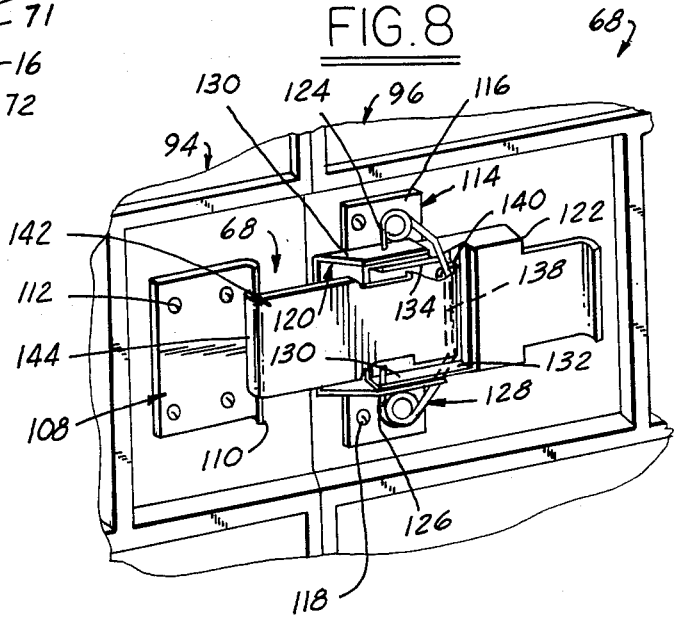
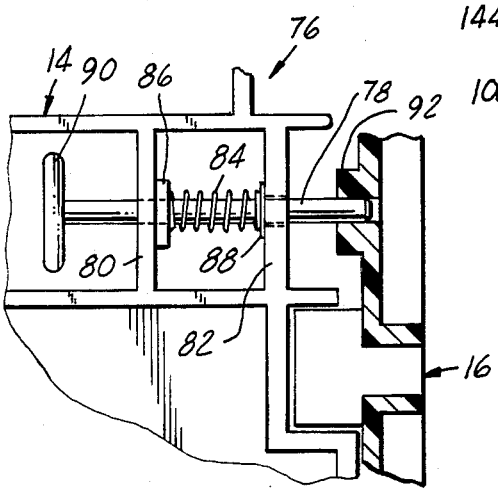
FIG.9

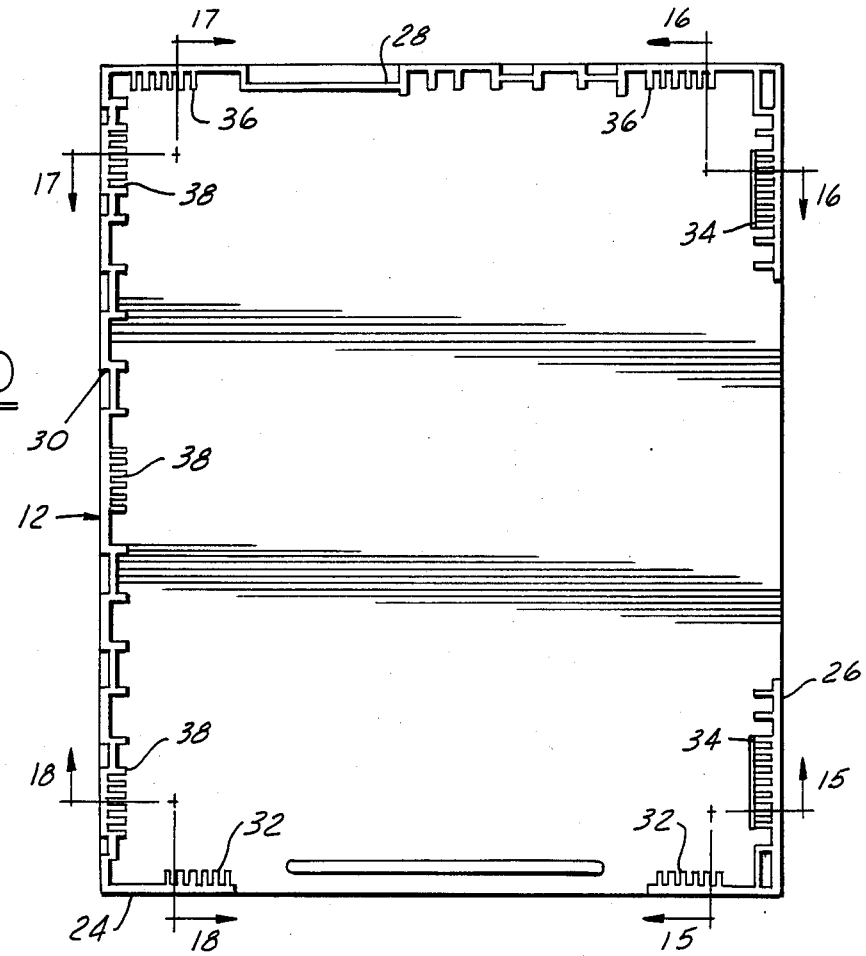
FIG. 10
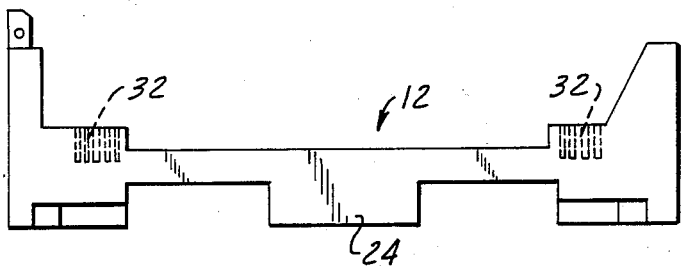
FIG. 11
FIG. 12
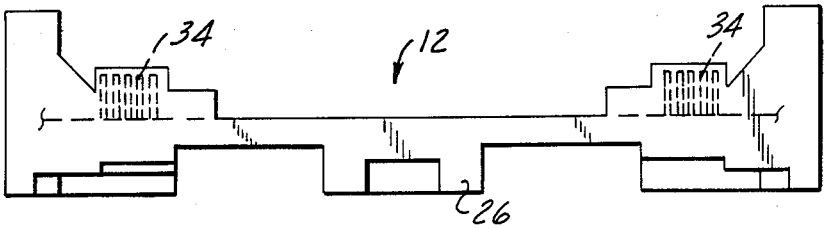
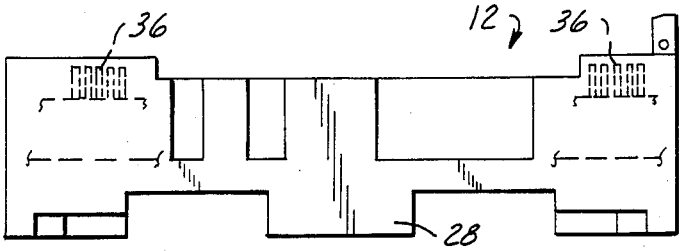
FIG. 13

COLLAPSIBLE BIN

BACKGROUND OF THE INVENTION

1. Field of the Invention

This invention relates to a collapsible bin construction having an erected configuration and a storage configuration. The bin construction includes a bottom wall and four collapsible side walls.

2. Prior Art

In modern manufacturing, it is common practice to assemble completed units at a single location from various parts and components which are shipped to the assembly locations. The parts and components are normally fabricated in facilities remote from the assembly location and shipped to the assembly location in containers. Two problems have arisen in connection with the use of prior art containers. One type of container which ha been in common use in the past is the throw-away containers. Such containers are fabricated of such materials as cardboard and low grade wood. Throw away containers have presented a serious disposal problem at assembly plants. Additionally, such throw away containers are not available in units of sufficient strength to ship heavy parts and components.

Reusable bins fabricated of metal and plastic have been in common use in the past. Such bins are strong in construction and are capable of retaining heavy parts and components. Such reusable containers have had the disadvantage of being expensive to transport empty back from an assembly location to the location of the origin of parts and components for refilling and reshipment. In accordance with the present invention a collapsible bin is provided which has a small collapsed configuration, is fabricated of plastic to be lightweight yet has a rugged construction.

SUMMARY OF THE INVENTION

The collapsible bin comprises a generally rectangular bottom wall, four side walls and a top wall. The bottom wall has upstanding wall structure along each edge thereof. First bottom wall hinge structure is provided on the upstanding wall structure along one edge of the bottom wall. Second bottom wall hinge structure is provided on the upstanding wall structure along a second adjacent edge of the bottom wall. The second hinge structure is positioned at a higher vertical level than the first hinge structure. Third bottom wall hinge structure is provided on the upstanding wall structure along a third adjacent edge of the bottom wall. The third hinge structure is positioned at a higher vertical level than the second hinge structure. Fourth bottom wall hinge structure is provided on the upstanding bottom wall structure along a fourth adjacent edge of the bottom wall. The fourth hinge structure is positioned at a higher vertical level than the third hinge structure.

Sidewall hinge structure is provided on the lower marginal edge portion of each side wall. Hinge connecting means pivotally secure each of the first, second, third and fourth bottom wall hinge structures to one of the side wall hinge structures whereby the side walls are hingedly secured to the bottom wall at successively higher vertical levels starting from the side wall secured to the first bottom wall hinge structure. The side walls are successively shorter from hinge structure to top with respect to the side wall mounted on the first bottom wall hinge structure so that when the side walls are in an upright position, the upper edges thereof are at substantially the same vertical level.

The side walls are configured so that, with the side walls in an upright position, the vertical edges of the side wall fastened to the first bottom wall hinge structure are positioned between the vertical edges of the two adjacent side walls, the vertical edges of the side wall fastened to the fourth bottom wall hinge structure are positioned outside of the vertical edges of the two adjacent side walls and one vertical edge of the side wall fastened to the second bottom wall hinge structure lies inside of the adjacent vertical edge of the side wall fastened to the third bottom wall hinge structure thereby permitting the side walls to be pivoted from an upright position to a collapsed position over the bottom wall with the side wall secured to the first bottom wall hinge structure being first collapsed onto the bottom wall, followed by collapsing the side wall secured to the second bottom wall hinged structure and then collapsing the side wall secured to the third bottom wall hinge structure and finally collapsing the side wall secured to the fourth bottom wall hinge structure.

The top wall comprises first and second sections. First top wall hinge means pivotally secures the first top wall section to one side wall and second top wall hinge means pivotally secures the second top wall section to the oppositely disposed side wall. The top wall sections are pivotable from a position overlying the interior of the bin with the side walls in an upright position to a position folded onto the exterior surface of the side wall to which they are secured to permit access to the interior of the bin and/or collapse of the side walls. The first top wall hinge means comprises a plurality of hinges. Each of these hinges includes a link pivotally secured at one end to said one side wall and pivotally secured at the other end to the first top wall section to permit limited movement of the first top wall section upon closure of the top wall to compensate for dimensional variations of an erected bin. The first top wall section is narrower than the second top wall section to reduce loading of the first top wall hinge means.

Two adjacent side walls have access opening means extending from the lower to the upper portion thereof to permit loading and unloading of the bin via the side walls. Door means are hingedly mounted over the opening means to maintain the integrity of the bin excepting when loading or unloading. Latch means are provided to releasably maintain the door means in a closed position. Releasable latch means are also provided on the side walls operable to secure the side walls to each other in an upright position.

BRIEF DESCRIPTION OF THE DRAWINGS

FIG. 5 is a view in perspective of the hinge structure provided for the doors in the side walls of the bin;

FIG. 6 is an exploded view in perspective illustrating hinge structure used to pivotally mount the side walls on the bottom wall;

FIG. 7 is a view in perspective of elastic latch means used to secure the top wall in place;

FIG. 8 is a view in perspective of a latch structure used to secure the side wall doors and the top wall sections in the closed position;

FIG. 9 is an elevational view of the spring urged pin structures partially in section which are located in the upper corners of the side walls to latch the side walls together in the upright position;

FIG. 10 is a top plan view of the bottom wall of the bin constructibn;

FIG. 11 is a view of the bottom wall in the direction of arrow 11 of FIG. 10;

FIG. 12 is an elevational view of the bottom wall viewed in the direction of arrow 12 of FIG. 10;

FIG. 13 is an elevational view of the bin bottom wall viewed in the direction of arrow 13 of FIG. 10;

DETAILED DESCRIPTION OF A PREFERRED EMBODIMENT

Figure 1:
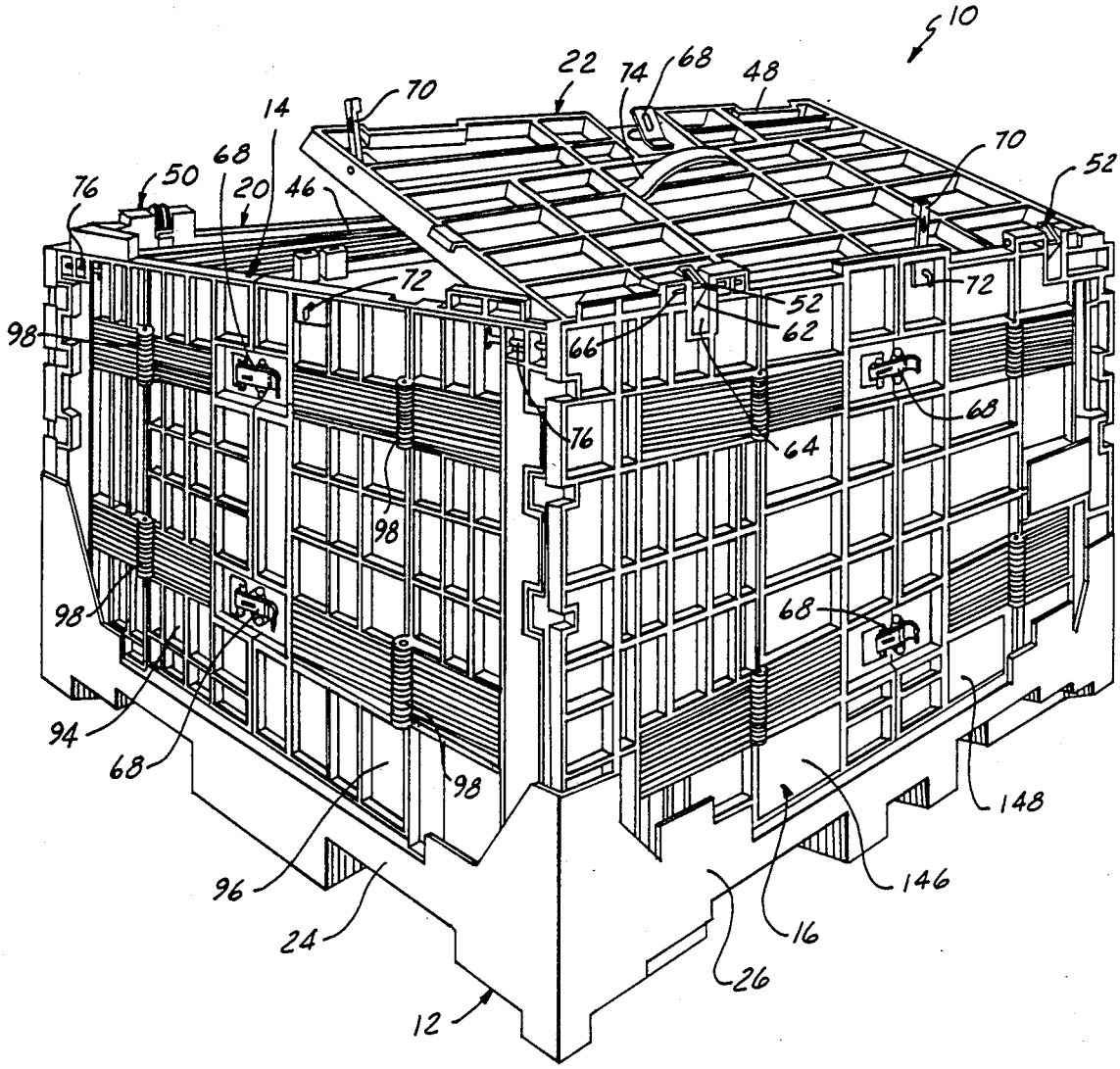
FIG. 1 is a view in perspective of one embodiment of the collapsible bin in accordance with the present invention shown in an erected condition.
Figure 19:
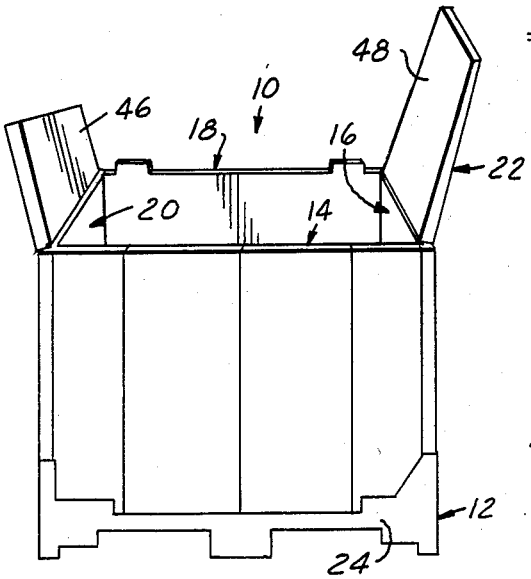
FIG. 19 is a diagrammatic view of an erected bin illustrating the first step for collapsing the bin.

Referring to FIGS. 1, 10 and 19, it will be noted that the collapsible bin 10 comprises a generally rectangular bottom wall 12, four side walls 14, 16, 18, 20, and a top wall 22. The wall structures are preferably fabricated of a tough plastic material such as polyethelene. The bottom wall 12 has upstanding wall structure along each edge thereof. This wall structure includes four portions 24, 26, 28, 30. As will be noted in FIGS. 11, 12, 13, 14, first bottom wall hinge structure 32 is provided on portion 24. Second bottom wall hinge structure 34 is provided on portion 26 along a second adjacent edge of the bottom wall 12. The second hinge structure 34 is positioned at a higher vertical level than the first hinge structure 32. Third bottom wall hinge structure 36 is provided on portion 28 along a third adjacent edge of the bottom wall 12. The third hinge structure 36 is positioned at a higher vertical level than the second hinge structure 34. Fourth bottom wall hinge structure 38 is provided on portion 30 along a fourth adjacent edge of the bottom wall. The fourth hinge structure 38 is positioned at a higher vertical level than the third hinge structure 36.

As will be noted in FIG. 6, side wall hinge structure 40, which is of the vane type to mate with the hinge structure above-mentioned, is provided on the lower marginal edge portion of each side wall, representatively, side wall 14. The vanes of the two hinge portions mesh together and are provided with central openings to receive a hinge pin 42 which is secured in place by means of a serrated fastener 44. This structure pivotally secures each of the first, second, third and fourth bottom wall hinge structures 32, 34, 26, 38 to one of the side wall hinge structures 40 whereby the side walls are hingedly secured to the bottom wall at successively higher vertical levels starting from the side wall 14 secured to the first bottom wall hinge structure 32. As will be noted, the side walls are successively shorter from hinge structure to top with respect to the side wall 14 mounted on the first bottom wall hinge structure 32 so that when the side walls are in an upright position as shown in FIG. 1, the upper edges thereof are at substantially the same vertical level.

Figure 20:
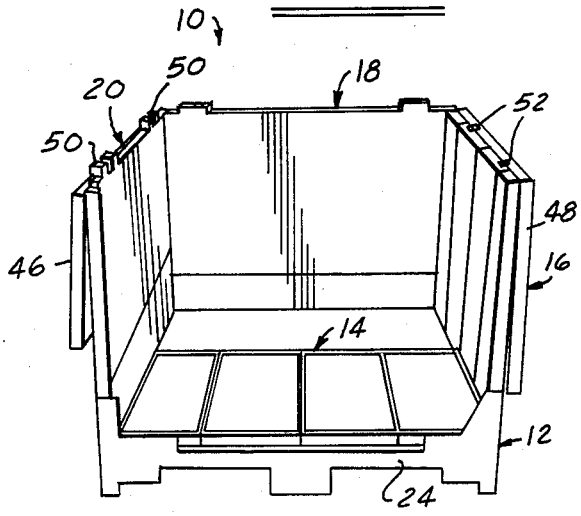
FIG. 20 is diagrammatic view of the bin illustrating the first side wall collapsed onto the bin bottom wall.
Figure 21:
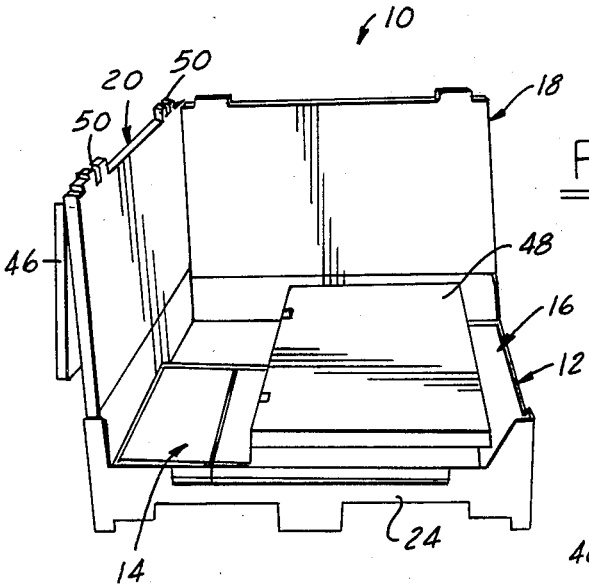
FIG. 21 is a diagrammatic view of the bin illustrating the second side wall collapsed onto the first side wall.
Figure 22:
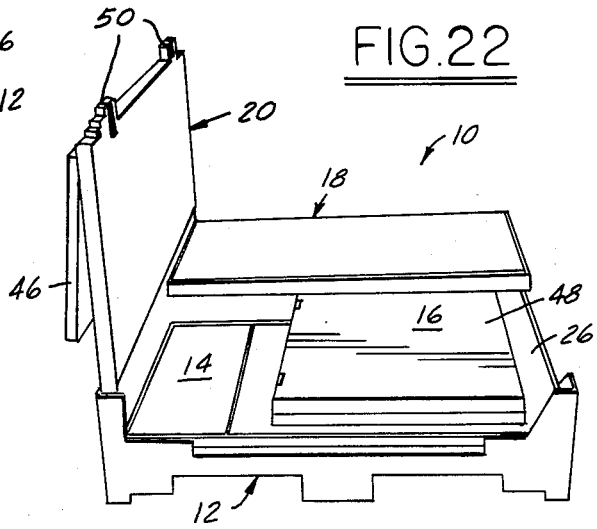
FIG. 22 is a diagrammatic view of the bin illustrating the third side wall collapsed onto the second side wall.
Figure 23:
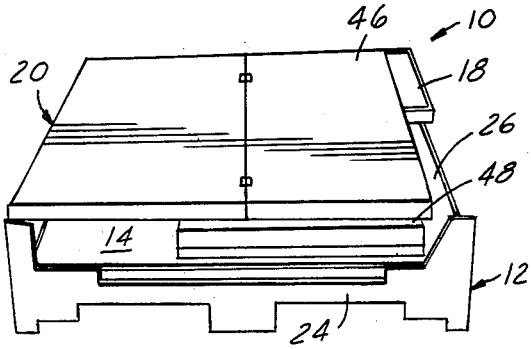
FIG. 23 is a diagrammatic view of the bin illustrating collapsing of the fourth side wall onto the side third wall.

As will be noted in FIGS. 19 and 20, the side walls are configured so that, with the side walls in an upright position, the vertical edges of the side wall 14 fastened to the first bottom wall hinge structure 32 are positioned between the vertical edges of the two adjacent side walls 16, 20. The vertical edges of the side wall 20 fastened to the fourth bottom wall hinge structure 38 are positioned outside of the vertical edges of the two adjacent side walls 14, 18. One vertical edge of the side wall 16 fastened to the second bottom wall hinge structure 34 lies inside of the adjacent vertical edge of the side wall 18 fastened to the third bottom wall hinge structure 36 (with the other vertical edge of the side wall 16 being on the outside of the vertical edge of the side wall 14 as a consequence of the structure previously described). The consequence of this arrangement is that, as shown in FIGS. 19, 20, 21, 22, 23, the bin is collapsible to the condition shown in FIG. 23 with the side walls being permitted to be pivoted from an upright position to a collapsed position over the bottom wall. This is accomplished by first opening the top wall 22 as shown in FIG. 19 (the top wall structure will be later described) and disengaging pin latching structure (to be later described). The side wall 14 which is secured to the first bottom wall hinge structure 32 is first collapsed onto the bottom wall 12 as shown in FIG. 20. This is followed by collapsing the side wall 16 secured to the second bottom wall hinge structure 34 as shown in FIG. 21. The side wall 18 which is secured to the third bottom wall hinge structure 36 is then collapsed as shown in FIG. 22. Finally, the remaining side wall 20 which is secured to the fourth bottom wall hinge structure 38 is collapsed as shown in FIG. 23.

The top wall 22 comprises first and second sections 46, 48. First top wall hinge means 50 pivotally secures the first top wall section 46 to side wall 20. Second top wall hinge means 52 pivotally secures the second top wall section 48 to the oppositely disposed side wall 16. The top wall sections are pivotable from a position overlying the interior of the bin 10 with the side walls in an upright position to a position folded onto the exterior surfaces of the side walls 16, 20 as shown in FIG. 20 to permit access to the interior of the bin and/or collapse of the side walls.

Figure 4:
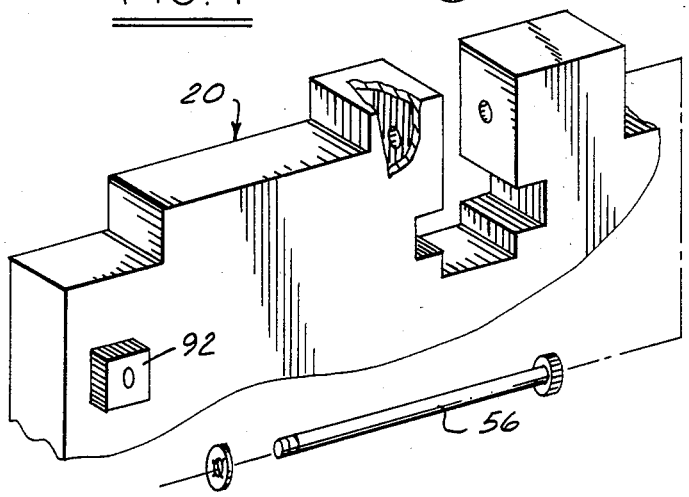
FIG. 4 is an exploded view in perspective of the hinge structure utilized for one section of the bin top wall.
Figure 14:
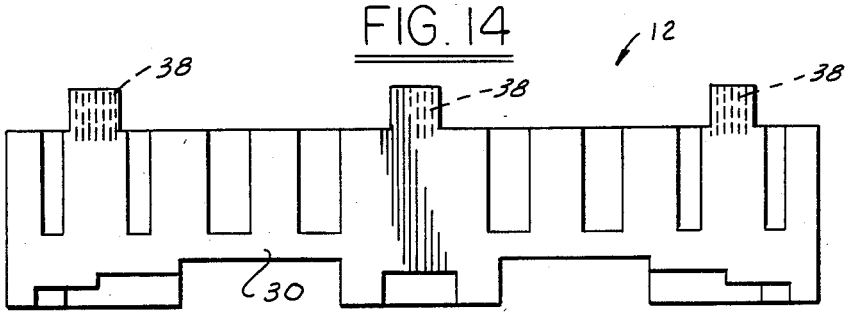
FIG. 14 is an elevational view of the bin bottom wall viewed in the direction of arrow 14 of FIG. 10.
Figure 15:
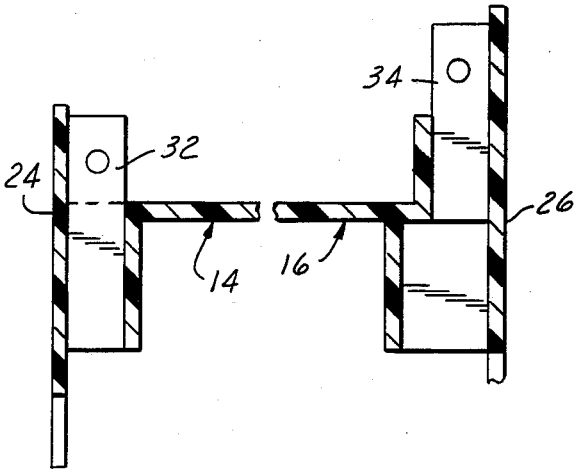
FIG. 15 is a sectional view taken substantially along the line 15—15 of FIG. 10 looking in the direction of the arrows.
Figure 16:
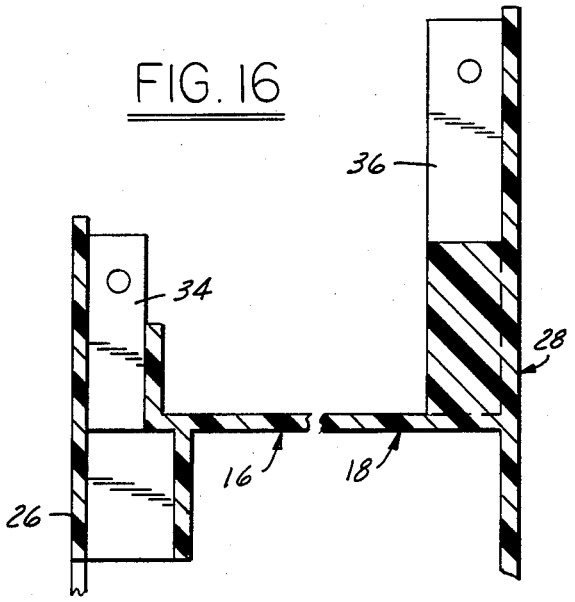
FIG. 16 is a sectional view taken substantially long the line 16—16 of FIG. 10 looking in the direction of the arrows.
Figure 17:
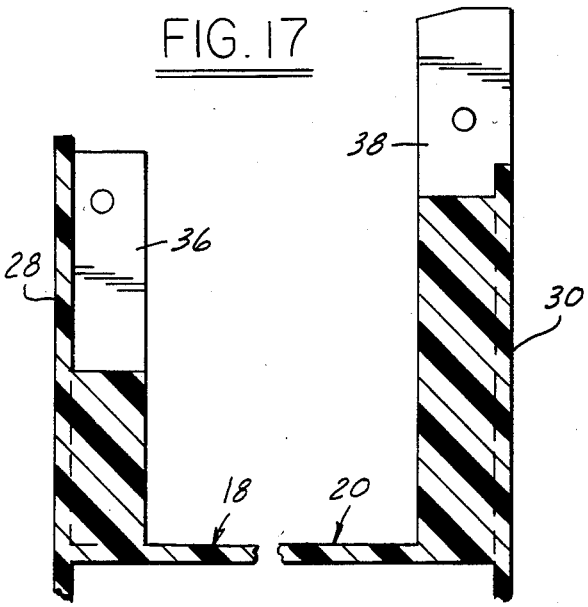
FIG. 17 is a sectional view taken substantially along the line 17—17 of FIG. 10 looking in the direction of the arrows.
Figure 18:
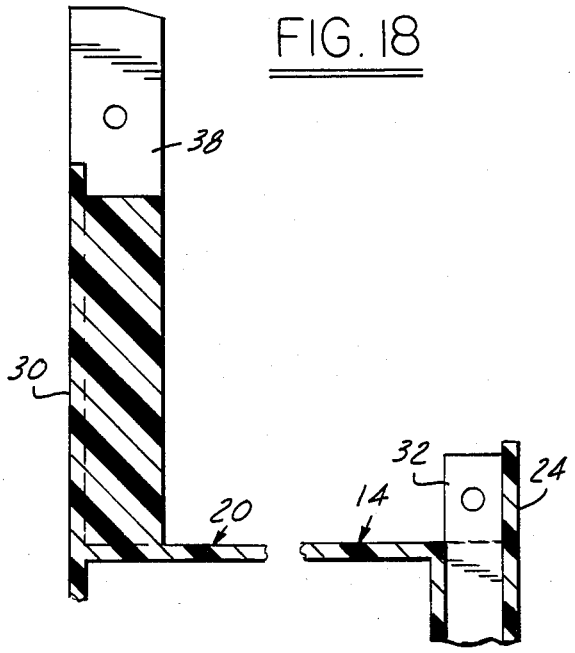
FIG. 18 is a sectional view taken substantially along the line 18—18 of FIG. 10 looking in the direction of the arrows.

FIG. 4 illustrates the construction of the first top wall hinge means 50, which are two in number in the embodiment shown. The hinge means comprises a link 54 which is pivotally secured to the side wall 20 by means of a pin 56. A projection 58, forming part of the top wall section 46, is pivotally secured by means of pin 60 to the other end of link 54 and is of course fixedly secured at its other end to the first top wall section 46. This double pivot construction permits limited lateral movement of the first top wall section 46 upon closure of the top wall to compensate for dimensional variations of an erected bin. It will be appreciated that the bin is of relatively large construction and there will inherently be certain deformations which might prevent complete closure of the top if the section 46 could not be moved a small degree laterally. It will be appreciated that the lateral movement results from the fact that the link 54 may assume different angular positions. The top wall section 46 is narrower than the top wall section 48 thus reducing the weight of section 46 and consequently the loading on the hinge structure. It will be appreciated that the double pin hinge structure is somewhat inherently weaker than a single pin hinge structure would be.

The other top wall section 48 is hingedly connected to the side wall 16 as illustrated in FIG. 1 by means of a projection 62 on the top wall section 48 which is received in a slot 64 provided in side wall 16. A hinge pin 66 secures the top wall section in place and permits pivoting thereof.

The top wall sections are secured in place by means of a clasp 68 and a pair of rubber straps 70. The clasp 68 is of the type shown in FIG. 8 and will be described in more detail hereinafter. The rubber straps 70 are each provided with an opening 71 as may be seen in FIG. 7. The straps 70 are pliable and can be stretched to fit over hooks 72. This latching means securely maintains the top wall in position during transportation of the bin 10. A flexible strap 74 is provided on the top wall section 48. The strap 74 functions as a handle to permit easy lifting of the section 48.

Releasable latch means 76 are provided on the side walls. These latch means are operable to secure the side walls to each other in an upright position. One of the latch means 76 is illustrated in FIG. 9. The latch means comprises a pin 78 which is slidably mounted in openings provided in side wall portions 80, 82. A coil spring 84 is mounted on the pin 78 between the side wall portions 80, 82. The spring 84 is mounted in compression. One end of the spring 84 bears against an enlargement 86 which is fixedly secured to the side wall portion 80. The other end of the spring 84 bears against a snap ring 88 which is secured to the pin 78. A manually engageable pin 90 is provided on the outer end of the pin 78. The pin 90 may be grasped by a hand to pull the pin 78 outwardly. The inner end of pin 78 is received in an opening provided in an enlarged portion 92 provided on the adjacent side wall structure 16. The pulling of the pin 78 out of engagement with the side wall 16 permits both side walls 14, 16 to be collapsed with respect to each other as shown in FIGS. 20, 21. Of course, additional latch means 76 are provided at each corner of the bin 10 of the side walls so that the side walls are all interconnected. In order to collapse, for example, side wall 14 is first necessary to disengage two of the latch means 76. This process is continued with each side wall to permit collapsing of each of the side walls as shown in FIGS. 20, 21, 22, 23.

Figure 2:
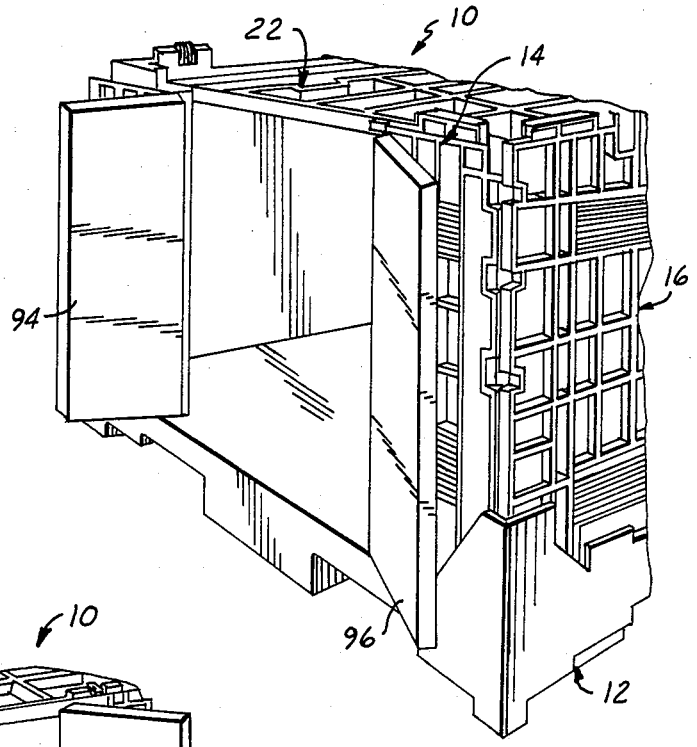
FIG. 2 is a perspective view of the collapsible bin of FIG. 1 illustrating the door means on one side wall for access to the interior of the bin.
Figure 3:
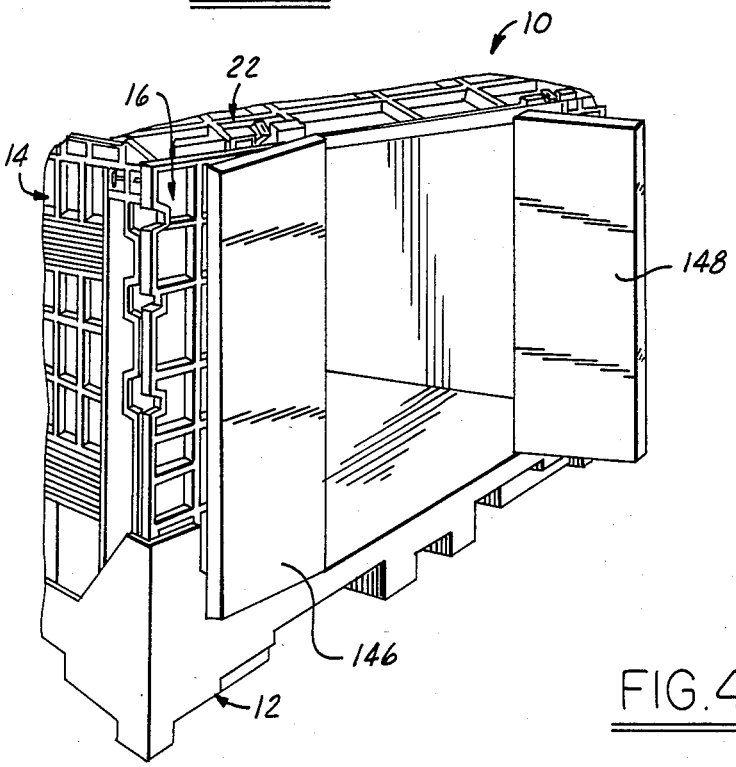
FIG. 3 is a view in perspective of the collapsible bin of FIG. 1 illustrating the door means on another side wall which facilitates access to the interior of the bin via a different wall.
Figure 3:
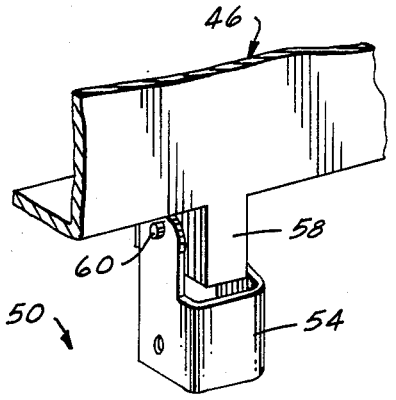

Each of the two adjacent side walls 14, 16 have access opening means extending from the lower to the upper portion thereof to permit loading and unloading of the bin 10 via the side walls 14, 16. The access opening means are illustrated in FIGS. 1, 2 and 3. As will be noted in FIG. 2, the access opening means in the side wall 14 comprises a pair of doors 94, 96. The doors are mounted on the bin 10 by means of hinge structure 98. The hinge structure 98 is illustrated in FIG. 5. As will be appreciated, this hinge structure is similar to that used to hingedly mount the side walls to the base. The hinge structure comprises interleaved vanes 100, 102 which mate to form a substantially strong hinge. The vanes have opening means therein and receive a hinge pin 104. The pin 104 is maintained in place by means of a snap ring 106. The doors 94, 96 maintain the integrity of the bin 10 excepting when loading or unloading.

A pair of latch means 68 are provided on the doors 94, 96 to releasably maintain the doors in a closed position. As shown in FIG. 8, the latches, which are in the form of a clasp, comprise a catch plate 108 including a hook 110. the catch plate 108 is secured to the door 94 as by rivets 112. A hasp latch 114 includes a mounting plate 116 which is secured to the other door 96 as by rivets 118. A bracket structure 120 extends outwardly from the plate 116 and sliding receives a manually actuatable latch handle 122. The latch handle 122 is pivotally secured to the bracket 120 by means of the ends 124, 126 of spring 128 which are received in openings provided in the walls 130, 132 forming part of the bracket 120 and walls 134, 136 forming part of the latch handle 122. The spring 128 has an elongated portion 138 which extends through the latch handle walls 134, 136 and through the curled end 140 of latch element 142. This arrangement pivotally attaches the latch element 142 to the latch handle 122. The latch element 142 has a hook portion 144 at its outer end which is adapted to engage the hook 110 of catch plate 108. The clasp 68 operates in substantially conventional fashion. When it is desired to disengage the clasp, the latch handle 122 is raised against the action of the spring 128 to move the latch element 142 forwardly and disenagage the hook 144 from the hook 110. It is then only necessary to flip the latch element 142 out of the way to completely disengage the clasp. The reverse procedure is followed when it is desired to engage the clasp 68. The spring 128 is positioned in an overcenter configuration so that the clasp 68 will be maintain itself in the latching position unless the latch handle 122 is manually lifted.

A similar door construction is provided on the adjacent side wall 16 as will be noted in FIGS. 1 and 3. Doors 146, 148 are hingedly mounted over the side wall access opening in the manner described with respect to the doors 94, 96. Clasps 68 are also provided for doors 146, 148 to maintain the doors in the closed position.

We calim:

1. A collapsible bin comprising a generally rectangular bottom wall, four side walls and a top wall, the bottom wall having upstanding wall structure along each edge thereof, first bottom wall hinge structure provided on said upstanding wall structure along one edge of the bottom wall, second bottom wall hinge structure provided on said upstanding wall structure along a second adjacent edge of the bottom wall, the second hinge structure being positioned at a higher vertical level than the first hinge structure, third bottom wall hinge structure provided on said upstanding wall structure along a third adjacent edge of the bottom wall, the third hinge structure being positioned at a higher vertical level than the second hinge structure, fourth bottom wall hinge structure provided on said upstanding wall structure along a fourth adjacent edge of the bottom wall, the fourth hinge structure being positioned at a higher vertical level than the third hinge structure, side wall hinge structure provided on the lower marginal edge portion of each side wall, hinge connecting means pivotally securing each of the first, second, third and fourth bottom wall hinge structures to one of the side wall hinge structures whereby the side walls are hingedly secured to the bottom wall at successively higher vertical levels starting from the side wall secured to the first bottom wall hinge structure, the side walls being successively shorter from hinge structure to top with respect to the side wall mounted on the first bottom wall hinge structure so that when the side walls are in an upright position, the upper edges thereof are at substantially the same vertical level, said side walls being configured so that, with the side walls in an upright position, the vertical edges of the side wall fastened to the first bottom wall hinge structure are positioned between the vertical edges of the two adjacent side walls, the vertical edges of the side wall fastened to the fourth bottom wall hinge structure are positioned outside of the vertical edges of the two adjacent side walls and one vertical edge of the side wall fastened to the second bottom wall hinge structure lies inside of the adjacent vertical edge of the side wall fastened to the third bottom wall hinge structure thereby permitting the side walls to be pivoted from an upright position to a collapsed position over the bottom wall with the side wall secured to the first bottom wall hinge structure being first collapsed onto the bottom wall, followed by collapsing the side wall secured to the second bottom wall hinge structure and then collapsing the side wall secured to the third bottom wall hinge structure and finally collapsing the side wall secured to the fourth bottom wall hinge structure, the top wall comprising first and second sections, first top wall hinge means pivotally securing the first top wall section to one side wall and second top wall hinge means pivotally securing the second top wall section to the oppositely disposed side wall, the top wall sections being pivotable from a position overlying the interior of the bin with the side walls in an upright position to a position folded onto the exterior surface of the side wall to which they are secured to permit access to the interior of the bin and/or collapse of the side walls, and releasable latch means on the side walls operable to secure the side walls to each other in an upright position, each of two adjacent side walls having access opening means extending from the lower to the upper portion thereof to permit loading and unloading of the bin via said side walls, door means hingedly mounted over said opening means to maintain the intergrity of the bin excepting when loading or unloading, and latch means to releasably maintain the door means in a closed position, the first top wall hinge means comprising a plurality of hinges, each of said hinges including a link pivotally secured at one end to said one side wall and pivotally secured at the other end to the first top wall section to permit limited lateral movement of the first top wall section upon closure of the top wall to compensate for dimensional variations of an erected bin.

2. A collapsible bin as defined in claim 1, further characterized in that the first top wall section is narrower than the second top wall section to reduce loading of the first top wall hinge means.

* * * * *